US007537503B2

(12) United States Patent
Hiroike et al.

(10) Patent No.: US 7,537,503 B2
(45) Date of Patent: May 26, 2009

(54) ELECTRON BEAM APPARATUS, AND METHOD FOR MANUFACTURING A SPACER USED FOR THE SAME

(75) Inventors: Taro Hiroike, Kanagawa (JP); Koji Yamazaki, Kanagawa (JP); Yoichi Ando, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 597 days.

(21) Appl. No.: 11/344,218

(22) Filed: Feb. 1, 2006

(65) Prior Publication Data

US 2006/0141892 A1 Jun. 29, 2006

Related U.S. Application Data

(62) Division of application No. 10/854,367, filed on May 27, 2004, now Pat. No. 7,053,537.

(30) Foreign Application Priority Data

Jun. 6, 2003 (JP) ..... 2003-161638

(51) Int. Cl.

| | |
|---|---|
| ***H01J 63/04*** | (2006.01) |
| ***H01J 1/62*** | (2006.01) |
| ***H01J 9/00*** | (2006.01) |
| ***H01J 9/24*** | (2006.01) |

(52) U.S. Cl. ..... 445/24; 313/495; 313/483; 313/496; 445/25; 445/1; 445/9; 445/14

(58) Field of Classification Search ..... None
See application file for complete search history.

(56) References Cited

U.S. PATENT DOCUMENTS

| | | | | |
|---|---|---|---|---|
| 5,532,548 | A | 7/1996 | Spindt et al. | 313/422 |
| 5,726,529 | A * | 3/1998 | Dean et al. | 313/495 |
| 5,760,538 | A | 6/1998 | Mitsutake et al. | 313/422 |
| 5,859,502 | A | 1/1999 | Spindt et al. | 315/169.3 |
| 5,936,343 | A | 8/1999 | Fushimi et al. | 313/495 |
| 5,990,614 | A | 11/1999 | Spindt | 313/495 |

(Continued)

FOREIGN PATENT DOCUMENTS

JP 2000195413 A * 7/2000

(Continued)

*Primary Examiner*—Mariceli Santiago
*Assistant Examiner*—Natalie K Walford
(74) *Attorney, Agent, or Firm*—Fitzpatrick, Cella, Harper & Scinto

(57) ABSTRACT

An electron beam apparatus in which a spacer having a high-resistance film coating a surface of a base material is inserted between a rear plate having electron emitting elements and row-direction wires, and a faceplate having a metal back. The row-direction wires and the metal back are electrically connected via the high-resistance film. An electric field near an electron emitting element near the spacer is maintained to substantially constant irrespective of the positional relationship between the spacer and the electron emitting element near the spacer. When a sheet resistance value of the high-resistance film on a first facing surface of the spacer that faces a row-direction wire is represented by R1, and a sheet resistance value of the high-resistance film on a side surface adjacent to the electron emitting element is represented by R2, R2/R1 is 10 to 200.

2 Claims, 11 Drawing Sheets

U.S. PATENT DOCUMENTS

| | | | | |
|---|---|---|---|---|
| 6,049,165 | A | 4/2000 | Spindt et al. | 313/495 |
| 6,053,791 | A | 4/2000 | Fujii et al. | 445/6 |
| 6,124,671 | A | 9/2000 | Fushimi et al. | 313/495 |
| 6,153,973 | A | 11/2000 | Shibata et al. | 313/495 |
| 6,342,754 | B1 | 1/2002 | Kuroda et al. | 313/292 |
| 6,441,544 | B1 | 8/2002 | Ando et al. | 313/310 |
| 6,506,087 | B1 | 1/2003 | Fushimi et al. | 445/24 |
| 6,509,691 | B2 | 1/2003 | Yamazaki et al. | 315/169.3 |
| 6,512,329 | B1 | 1/2003 | Mitsutake et al. | 313/495 |
| 6,534,911 | B1 | 3/2003 | Ando | 313/496 |
| 6,566,794 | B1 | 5/2003 | Miyazaki | 313/292 |
| 6,802,753 | B1 | 10/2004 | Ando et al. | 445/6 |
| 6,803,715 | B1 | 10/2004 | Mitsutake et al. | 313/495 |
| 6,884,138 | B1 | 4/2005 | Ando et al. | 445/24 |
| 6,984,160 | B2 * | 1/2006 | Ando et al. | 445/24 |
| 7,132,026 | B2 * | 11/2006 | Shioya et al. | 156/160 |
| 7,247,981 | B2 * | 7/2007 | Yamazaki | 313/497 |
| 7,391,149 | B2 * | 6/2008 | Yamazaki | 313/495 |
| 7,400,082 | B2 * | 7/2008 | Suzuki et al. | 313/473 |
| 2002/0005692 | A1 | 1/2002 | Ando | 313/495 |
| 2003/0164675 | A1 | 9/2003 | Ando | 313/495 |
| 2004/0080259 | A1 | 4/2004 | Ando | 313/495 |
| 2004/0227453 | A1 | 11/2004 | Ando et al. | 313/495 |
| 2005/0146260 | A1 | 7/2005 | Yamazaki | 313/292 |

FOREIGN PATENT DOCUMENTS

| | | |
|---|---|---|
| JP | 2000-311633 | 11/2000 |

* cited by examiner

ELECTRON BEAM APPARATUS, AND METHOD FOR MANUFACTURING A SPACER USED FOR THE SAME

This application is a division of U.S. application Ser. No. 10/854,367 filed May 27, 2004, now U.S. Pat. No. 7,053,537, issued May 30, 2006.

BACKGROUND OF THE INVENTION

1. Field of the Invention

The present invention relates to an electron beam apparatus used as an image forming apparatus, such as a panel-type image display apparatus, an image recording apparatus, or the like, and more particularly, to an electron beam apparatus using a spacer covered with a high-resistance film in which a very small current can flow, and a method for manufacturing the spacer.

2. Description of the Related Art

In general, a panel-type electron beam apparatus has a configuration in which a first substrate having electron emitting elements and wires for driving the electron emitting elements, and a second substrate having a conductive member that is set to a potential different from a potential of the wires, face each other with a spatial interval separating the substrates. The circumference of the first and second substrates is sealed. In order to obtain a necessary atmospheric pressure-resistant property, an insulating spacer is inserted between the first and second substrates. However, there is a problem that the spacer can become charged so as to deviate an electron emission position by influencing an electron trajectory near the spacer, thereby tending to cause, for example, a decrease in the luminance of a pixel near the spacer, or a degradation of an image, such as color mixture, or the like. The conductive member of the second substrate is used, for example, as an acceleration electrode for accelerating electrons emitted from an electron emitting element. Since a high voltage is applied to the conductive member, charging of the surface of the spacer may cause creeping discharge.

It has been known that, as described in Patent Literature 1 referred to below, charging of the surface of the spacer is prevented by causing a very small current to flow in the spacer. More specifically, a high-resistance film, serving as a charging preventing film, is formed on the surface of the insulating spacer, the high-resistance film is connected to wires on the first substrate and the conductive member of the second substrate via a low-resistance conductive member, and a very small current is caused to flow in the surface of the spacer. The low-resistance conductive member is formed on the contact surfaces between the spacer, and a faceplate and a rear plate.

It is also known that, as disclosed in Patent Literature 2 referred to below, by providing at least one low-resistance electrode for deflection or convergence of an electron trajectory on the surface-of the spacer, an electron trajectory near the spacer can be controlled by controlling the potential of the electrode.

Patent Literature 1: U.S. Pat. No. 5,760,538

Patent Literature 2: U.S. Pat. No. 5,859,502

However, the above-described conventional techniques have the following problems.

That is, when a low-resistance portion, such as an electrode, is formed on the surface of the spacer, and the positional relationship between the spacer and an electron emitting element near the spacer deviates from a desired position, since the distribution of the electric field near the spacer greatly changes, an electron trajectory near the spacer changes, thereby sometimes causing deviation in the position of arrival of an electron beam. Such deviation of the positional relationship between the spacer and the electron emitting element may occur, for example, when the installment position of the spacer deviates from a predetermined desired position, when the spacer is inclined, or when the shape of the base material of the spacer differs from a desired shape.

In order to suppress the above-described deviation of the position of arrival of the electron beam, for example, it is necessary to (a) suppress variations of the electric-field distribution to a position deviation that does not greatly influence the electron trajectory by improving the accuracy in the installment position of the spacer during manufacture of an electron beam apparatus, (b) improve the accuracy in processing of the base material of the spacer, or (c) improve the accuracy in the position of an electrode formed on the spacer surface. Deviation in the position of arrival of an electron beam can also be suppressed by controlling the electron trajectory by appropriately adjusting the potential of an electrode formed on the spacer surface in accordance with deviation of the position of the spacer.

However, these methods will cause a complicated manufacturing process, a decrease in the production yield, or complicated control of the apparatus, resulting in an increase in the production cost. Even if assembly with high accuracy is performed, it is often difficult to prevent deviation of the position at a subsequent heat process, or the like. Furthermore, when the relative position with a near electron emitting element is not constant within one spacer, for example, when the spacer has the shape of a rib or a plate, is bent in the longitudinal (long-axis) direction, or is not parallel, the influence of the spacer sometimes cannot be completely removed according to the above-described methods.

SUMMARY OF THE INVENTION

The present invention has been made in consideration of the above-described problems.

It is an object of the present invention to provide an electron beam apparatus that can maintain an electric field near an electron emitting element positioned near a spacer substantially constant irrespective of the positional relationship between the surface of the spacer and the electron emitting element positioned near the spacer, and a method for manufacturing a spacer used for the electron beam apparatus.

According to one aspect of the present invention, an electron beam apparatus including a first substrate having electron emitting elements and a first conductive member, a second substrate having a second conductive member set to a potential different from a potential of the first conductive member, and a spacer having a high-resistance film covering a surface of a base material that is inserted between the first conductive member and the second conductive member in a state of contacting the first conductive member and the second conductive member. The first conductive member and the second conductive member are electrically connected via the high-resistance film. When a sheet resistance value of the high-resistance film on a first facing surface of the spacer that faces the first conductive member is represented by R1, and a sheet resistance value of the high-resistance film on a side surface adjacent to the electron emitting element is represented by R2, R2/R1 is 2-200.

It is preferable that R2/R1 is 5-100, that R2 is $10^7$-$10^{14}$ Ω/□, and that the second substrate has an image forming member for forming an image by irradiation of an electron-beam from the electron emitting elements.

According to another aspect of the present invention, a method for manufacturing a spacer having a high-resistance film covering a surface of a base material, that is inserted between a first substrate having electron emitting elements, and a first conductive member, and a second substrate having a second conductive member set to a potential different from a potential of the first conductive member in a state of contacting the first conductive member and the second conductive member, and electrically connects the first conductive member and the second conductive member via the high-resistance film includes a step of forming the high-resistance film according to a film forming step that includes a step of performing film formation from a direction of a first facing surface that faces the first conductive member, and a step of performing film formation from a direction of a side surface adjacent to the electron emitting element.

It is preferable that the film forming step is a step of forming the high-resistance film in which, when a sheet resistance value of the high-resistance film on the first facing surface is represented by R1, and a sheet resistance value of the high-resistance film on the side surface is represented by R2, R2/R1 is 2-200.

It is preferable that the film forming step is a step of performing film formation from a direction of a second facing surface facing the second conductive member, that is performed in the same film forming condition as film formation from the direction of the first facing surface at a time simultaneous with or different from the step of performing film formation from the direction of the first facing surface.

It is preferable that, when a sheet resistance of the high-resistance film on the first facing surface and the second facing surface obtained when performing film formation only from the direction of the first facing surface and the direction of the second facing surface is represented by r1, a sheet resistance of the high-resistance film on the side surface obtained when performing film formation only from the direction of the side surface is represented by R1, a sheet resistance of the high-resistance film on the side surface obtained when performing film formation only from the direction of the first facing surface and the direction of the second facing surface is represented by r2', and a sheet resistance of the high-resistance film on the first facing surface and the second facing surface obtained when performing film formation only from the direction of the side surface is represented by r1', film formation in the film forming step satisfies the following relationship:

$$r1<r1',$$

$$r2<r2',$$

and $$(r1\times r2')/(r1+r2')<(r2\times r1')/(r2+r1').$$

According to still another aspect of the present invention, a method for manufacturing a spacer having a high-resistance film covering a surface of a base material, that is inserted between a first substrate having electron emitting elements and a first conductive member, and a second substrate having a second conductive member set to a potential different from a potential of the first conductive member in a state of contacting the first conductive member and the second conductive member, and electrically connects the first conductive member and the second conductive member via the high-resistance film includes a step of forming the high-resistance film according to a film forming step of performing film formation only from a direction of a first facing surface facing the first conductive member and a direction of a second facing surface facing the second conductive member.

In the above-described manufacturing method, it is preferable that, when a sheet resistance value of the high-resistance film on the first facing surface and the second facing surface is represented by R1, and a sheet resistance value of the high-resistance film on a side surface adjacent to the electron emitting element is represented by R2, R2/R1 is 2-200, and that R2 is $10^7$-$10^{14}$ Ω/□.

The foregoing and other objects, features and advantages of the present invention will become more apparent from the following detailed description of the preferred embodiments taken in conjunction with the accompanying drawings.

DETAILED DESCRIPTION OF THE PREFERRED EMBODIMENTS

First, an electron beam apparatus according to an embodiment of the present invention will be described in detail with reference to the drawings.

Figure 1:
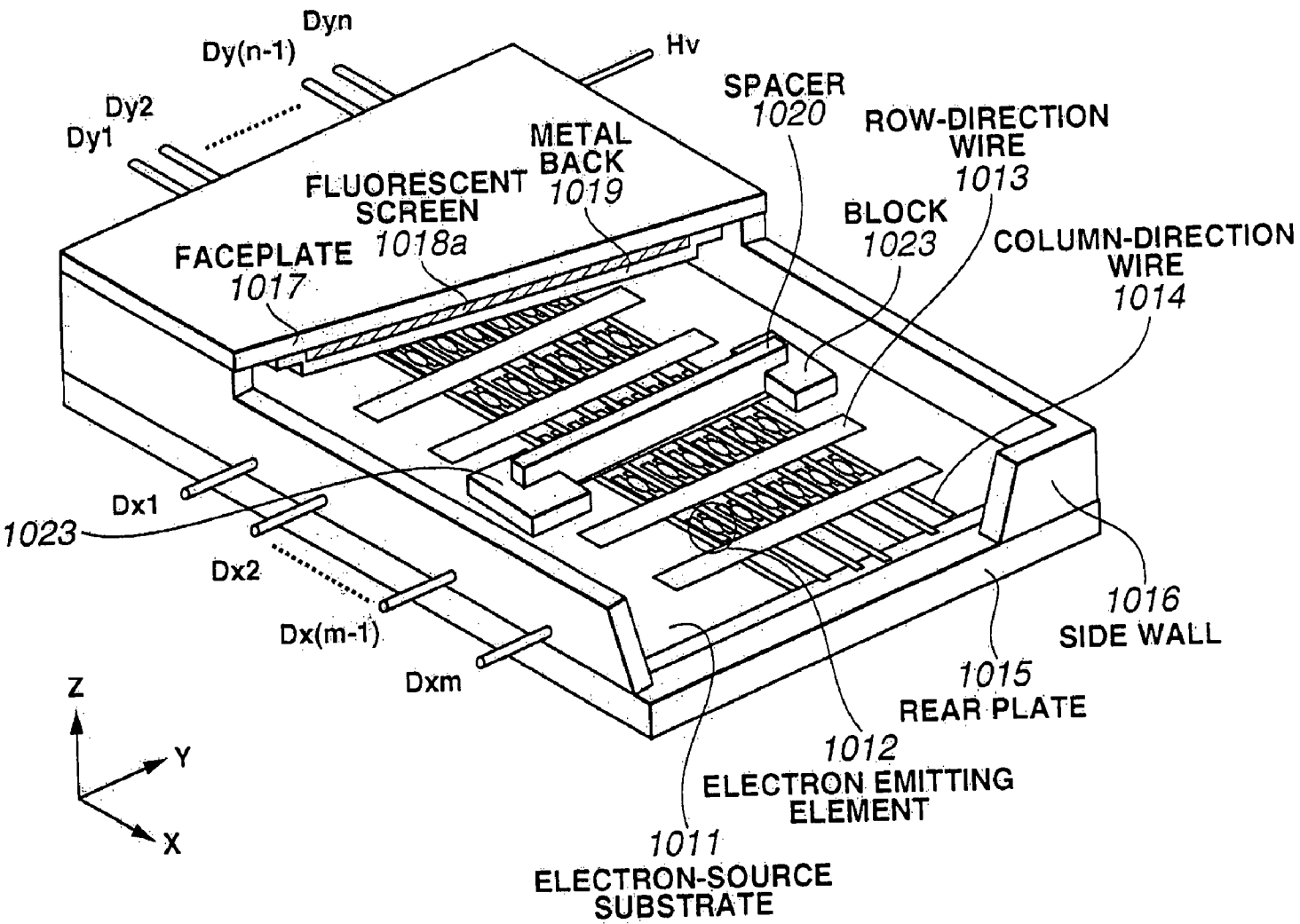
FIG. 1 is a partially broken perspective view illustrating an electron beam apparatus-according to the present invention.
Figure 2:
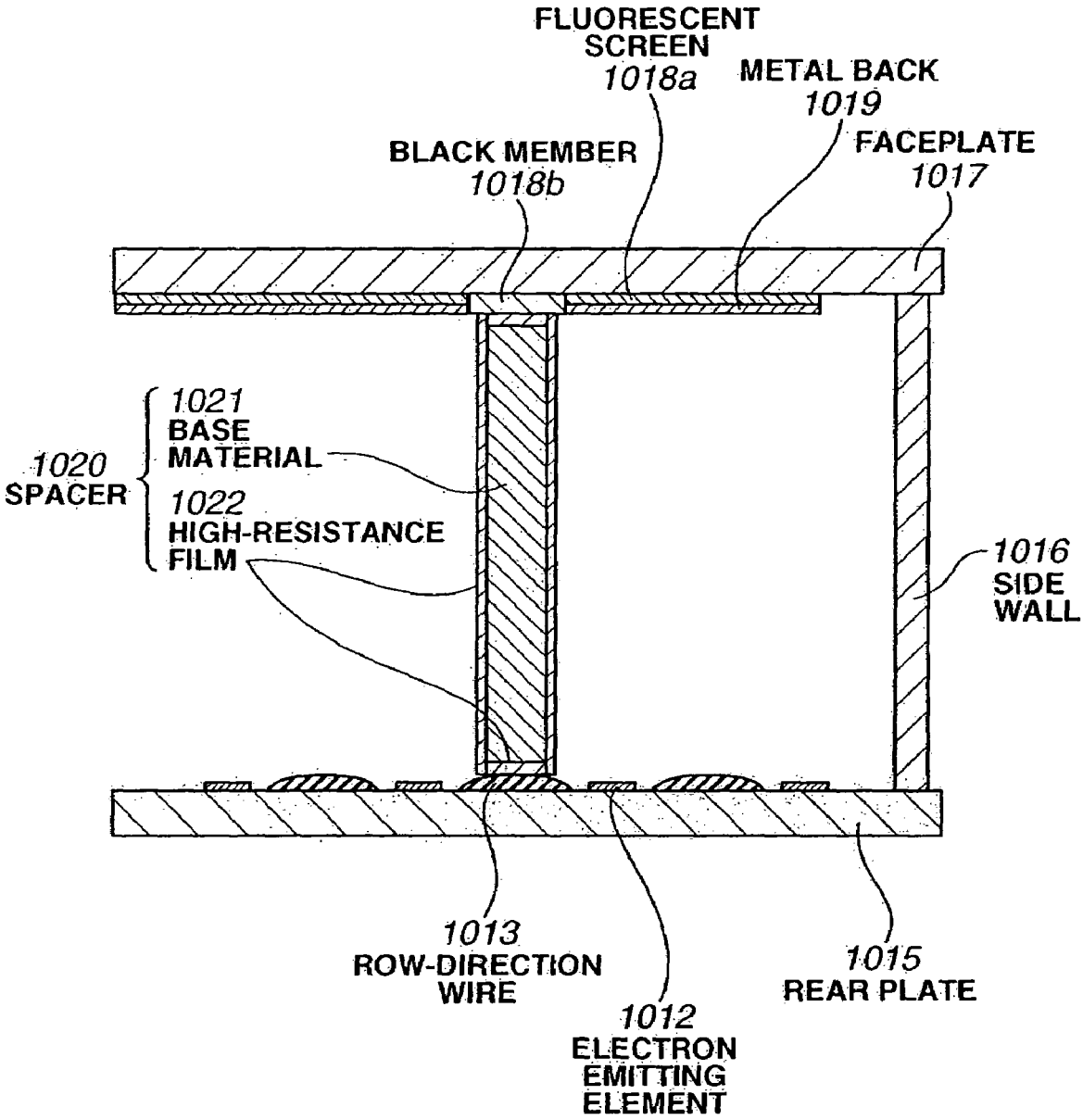
FIG. 2 is an enlarged cross-sectional view illustrating a portion near a spacer shown in FIG. 1.
Figure 3:
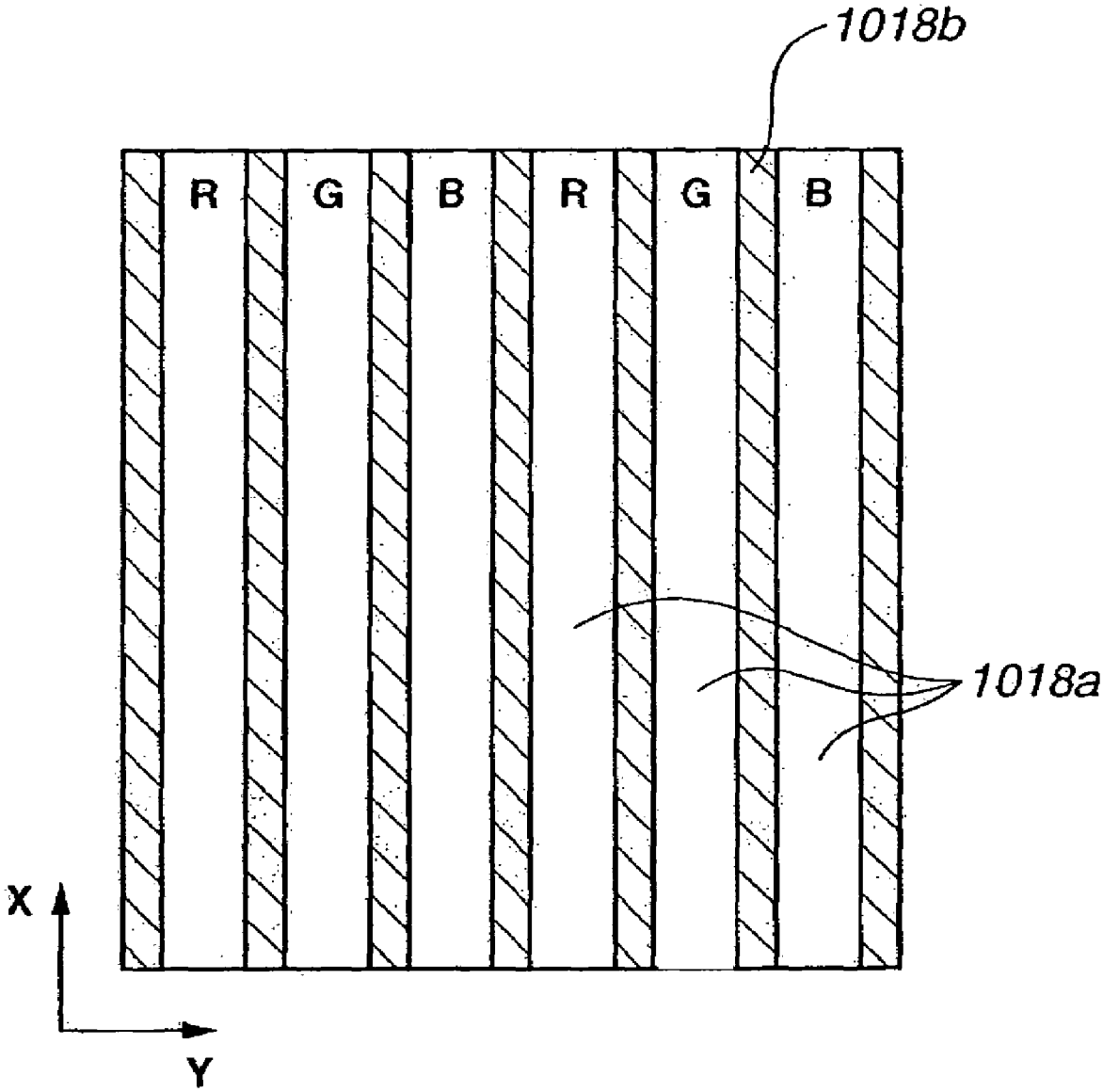
FIG. 3 is a diagram illustrating a fluorescent screen shown in FIG. 1.

FIG. 1 is a partially broken perspective view illustrating the electron beam apparatus according to the present embodiment. FIG. 2 is an enlarged cross-sectional view illustrating a portion near a spacer shown in FIG. 1. FIG. 3 is a diagram illustrating a fluorescent screen shown in FIG. 1.

This electron beam apparatus is a panel-type image display apparatus. In FIGS. 1 and 2, a rear plate 1015 serves as a first substrate. A faceplate 1017 serves as a second substrate. A side wall 1016 is inserted at the circumference of the rear plate 1015 and the faceplate 1017 that are arranged so as to face each other with a gap in between them. These members constitute an airtight container, and an internal space surrounded by these members is maintained at a vacuum atmosphere.

A predetermined number of spacers 1020 are inserted between the rear plate 1015 and the faceplate 1017, in order to maintain a predetermined spatial interval between the rear plate 1015 and the faceplate 1017 and prevent destruction of the airtight container due to a pressure difference between the outside and the inside of the container. Blocks 1023 used for fixing the individual spacers 1020 at a desired position are fixed to the rear plate 1015, and hold both ends of the spacer 1020.

An electron-source substrate 1011 has N×M electron emitting elements 1012 formed thereon, and is fixed on the rear plate 1015. N and M are positive integers equal to or larger than 2, and are appropriately set in accordance with the target number of display pixels. For example, in a display apparatus for display of high-quality television, N and M are desirably equal to or larger than 3,000 and 1,000, respectively. Although the illustrated electron emitting element 1012 is a surface-conduction electron emitting element in which a conductive thin film having a crack, serving as an electron emitting port-ion, is formed, wherein the thin film is connected between a pair of element electrodes, any other appropriate cold-cathode element, such as a field-emission electron emitting element, or the like, may also be used.

The above-described N×M electron emitting elements 1012 are subjected to simple matrix wiring using M row-direction wires, serving as first conductive members, and N column-direction wires 1014, subjected to matrix driving. An electron source portion constituted by the N×M electron emitting elements 1012, the M row-direction wires 1013, and the N column-direction wires 1014 will hereinafter be termed a multi-electron beam source.

A fluorescent screen 1018*a* is formed on the lower surface (inner surface) of the faceplate 1017. This image display apparatus performs color display, and phosphors of three primary colors, i.e., red (R), blue (B) and green (G), are individually coated on the fluorescent screen 1018*a*. Phosphors of the respective colors are individually coated in the form of stripes, as shown in FIG. 3, and a black member (black stripe) 1018*b* is provided between adjacent stripes.

A metal back 1019, serving as a second conductive member, set to a potential different from a potential of the row-direction wires 1013 and the column-direction wires 104 provided at the rear plate 1015 is provided on a surface of the fluorescent screen 1018*a* facing the rear plate 1015. The metal back 1019 is provided in order to improve the efficiency of utilization of light emitted from the phosphors constituting the fluorescent screen 1018*a*, and to protect the fluorescent screen 1018*a* from shock by ions, and the like, and also functions as an electrode for applying an acceleration voltage for accelerating electrons emitted from the electron emitting elements 1012.

The details of the configuration and the manufacturing method of the multi-electron beam source, the faceplate, and the display panel including these components are described in Japanese Patent Application Laid-Open (Kokai) No. 2000-311633.

The spacer 1020 will now be further described. As shown in FIG. 2, the spacer 1020 is obtained by forming a high-resistance film 1022 on the surface of a base material 1021 made of an insulating material. The high-resistance film 1022 is formed on side surfaces of the spacer 1020 adjacent to the electron emitting elements 1012, and on a first facing surface of the spacer 1020 facing the row-direction wire 1013 on the rear plate 1015, and on a second facing surface of the spacer 1020 facing the metal back 1019 on the faceplate 1017. The high-resistance film 1022 also may be formed on the surface of the spacer 1020 facing the block 1023 although this is not represented in FIG. 2. However, since this surface is not adjacent to the electron emitting elements 1012, formation of the high-resistance film 1022 on this surface may be omitted.

It is preferable that the base material 1021 of the spacer 1020 have a sufficient mechanical strength for supporting atmospheric pressure applied to the electron beam apparatus, and a heat-resistant property to protect against heat applied during a process for manufacturing the electron beam apparatus. Glass, ceramics, or the like, may be suitably used as the base material 1021, although other suitable materials may be used instead.

The high-resistance film 1022 is formed in order to mitigate charging generated on the surface of the spacer 1020, and must have a sheet resistance value necessary for removing charges. Preferably, the sheet resistance value of the high-resistance film 1022 is desirably equal to or less than $10^{14}$ Ω/□, and more preferably is equal to or less than $10^{12}$ Ω/□ in order to obtain a sufficient effect. If the sheet resistance value is too small, power consumption in the spacer 1022 increases. Accordingly, the sheet resistance value of the high-resistance film 1022 is preferably at least $10^{7}$ Ω/□.

For example, a metal oxide, a nitride of aluminum and a transition metal, a nitride of germanium and a transition metal, carbon, amorphous carbon, or the like may be used for the high-resistance film 1022. An oxide of chromium, nickel or copper is preferable as the metal oxide, because these oxides have relatively small secondary-electron emission efficiencies, so that, even if electrons emitted from the electron emitting element 1012 impinge upon the spacer 1020, the amount of generated charges is small. A nitride of aluminum and a transition metal is preferable because the resistance value can be controlled within a wide range from a good conductor to an insulator by adjusting the composition of the transition metal. Transition-metal elements include Ti, Cr, Ta, and the like. A nitride of germanium and a transition metal can be preferably used for the high-resistance film 1022 because such a nitride can have an excellent charging mitigating property by adjusting the composition of the transition metal. Transition-metal elements include Ti, V, Cr, Mn, Fe, Co, Ni, Cu, Zr, Nb, Mo, Hf, Ta, and the like. Such a transition metal may be used by itself, or at least two types of transition metals may be used together. Carbon is preferable because it has a small secondary-electron emission efficiency. Particularly, amorphous carbon can easily control the resistance of the high-resistance film 1022 to a desired value because it has a high resistance.

The high-resistance film 1022 can be formed on the insulating base material 1021 according to a vapor-phase thin-film forming method, such as sputtering, electron-beam vacuum deposition, ion plating, ion-assisted vacuum deposition, CVD (chemical vapor deposition), plasma CVD, spraying, or the like, depending on the type of the high-resistance film 1022 employed, or according to a liquid-phase thin-film forming method, such as dipping, or the like.

The first facing surface and the second facing surface of the spacer 1020 contact the row-direction wire 1013 and the metal back 1019, respectively, so as to electrically connect the row-direction wire 1013 and the metal back via the high-resistance film 1022. Although in the illustrated embodiment, the first facing surface of the spacer 1020 contacts the row-direction wire 1013, a contact wire or electrode may be separately provided on the rear plate 1015 as a first conductive member, so as to contact the spacer 1020. The second facing surface of the spacer 1020 contacts the metal back 1019.

However, when the metal back 1019 is provided at the inner side of the fluorescent screen 1018*a*, the black member 1018*b* may comprise a conductor in order to contact the spacer 1020 as a second conductive member.

Figure 9:
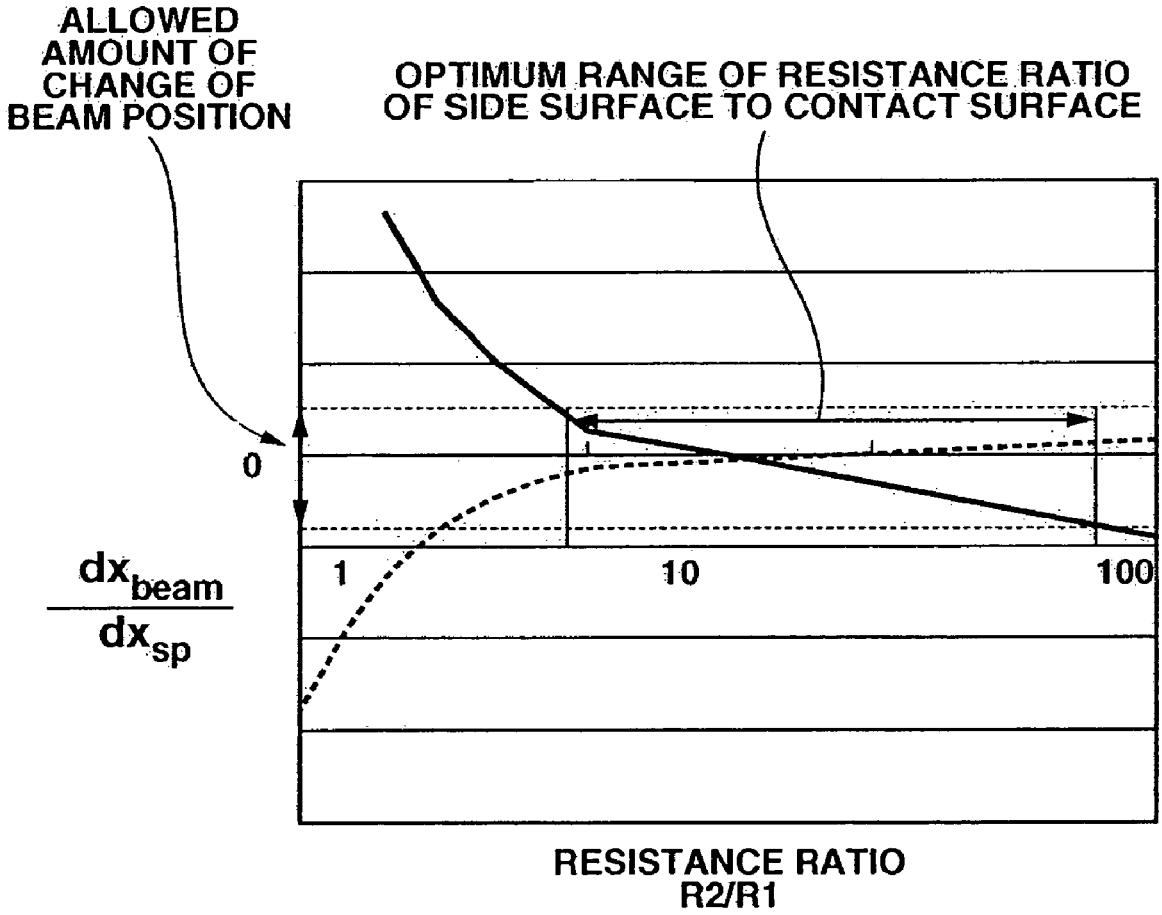
FIG. 9 is a graph illustrating a dependency of the degree of sensitivity of an electron trajectory with respect to an amount of position deviation of the spacer on the resistance ratio R2/R1 of the side surface to the contact surface, obtained according to simulation.

In the present invention, when the sheet resistance value of the high-resistance film 1022 at least on the first facing surface, preferably, on the first facing surface and the second facing surface is represented by R1, and the sheet resistance value of the high-resistance film 1022 on the side surface adjacent to the electron emitting element 1012 is represented by R2, a desired function can be obtained by making R2/R1 to 2-200, and preferably, to 5-100. FIG. 9 illustrates the dependency of the degree of sensibility (the degree of influence) of an electron trajectory with respect to the amount of position deviation of the spacer 1020 in this electron-beam apparatus upon the resistance ratio R2/R1 of the side surface to the contact surface, obtained according to simulation. The degree of sensibility (the degree of influence) represented as the ordinate is defined by $dx_{beam}/dx_{sp}$ when the amount of position deviation of the spacer 1020 from a normal position is represented by $dx_{sp}$, and the amount of deviation of the electron trajectory near the spacer 1020 from a normal position of arrival is represented by $dx_{beam}$. In FIG. 9, a curve illustrated by a solid line shows a result of calculation for electrons emitted from the electron emitting element 1012 at a side where the spacer 1020 approaches, and a curve illustrated by a broken line shows a result of calculation for electrons emitted from the electron emitting element 1012 at a side where the spacer 1020 is separated. When the value of $dx_{beam}$ is positive, it indicates that the electron trajectory moves in a direction of being attracted by the spacer 1020 in accordance with position deviation of the spacer 1020. When the value of $dx_{beam}$ is negative, it indicates that the electron trajectory moves in a direction of being repelled from the spacer 1020 in accordance with position deviation of the spacer 1020.

As shown in FIG. 9, the degree of sensitivity of the electron trajectory with respect to the position deviation of the spacer 1020 changes as the resistance ratio changes. Particularly, when the resistance ratio is small and large, the degree of sensitivity (the degree of influence) of the amount of change of an electron beam with respect to the position deviation of the spacer 1020 has reverse signs. Accordingly, it can be understood that the degree of sensitivity of the electron trajectory with respect to the position deviation of the spacer 1020 is extremely small at a certain intermediate condition. As shown in FIG. 9 by the broken line, when the position of the spacer 1020 deviates in a direction of being separated from (away from) the electron emitting element 1012, and the resistance ratio exceeds about 2, the amount of change in deviation of the electron beam rapidly decreases. Although not illustrated explicitly in FIG. 9, when the resistance ratio exceeds 200, the amount of change in deviation of the electron beam rapidly increases. When the position of the spacer 1020 deviates in a direction of approaching (forwards) the electron emitting element 1012, the degree of sensitivity (the degree of influence) is large as compared to when the position of the spacer 1020 deviates in a direction of being separated from (i.e., away from) the electron emitting element 1012. In this case, when the resistance ratio exceeds 5, the amount of change of deviation of the electron beam rapidly decreases, and when the resistance ratio exceeds 100, the amount of change in deviation of the electron beam rapidly increases. Accordingly, the resistance ratio of the spacer 1020 is preferably 2 to 200, and more preferably, 5 to 100. By thus setting the resistance ratio to at least 2, even if the installment position of the spacer 1020 deviates, it is possible to suppress influence (the degree of sensitivity) on the electron trajectory to a negligible degree, and realize excellent electric connection between the spacer 1020 and the first conductive member (or the second conductive member). Furthermore, by setting the resistance ratio to a value equal to or less than 200, it is possible to securely perform electric connection between the spacer 1020 and the first conductive member, and suppress influence (the degree of sensitivity) on the electron trajectory to a negligible degree even if the installment position of the spacer 1020 deviates. In addition, even if a film forming material is also deposited by straying on a side surface when forming the high-resistance film 1022 on the first facing surface and the second facing surface, the influence on the resistance distribution of the side surface can be minimized to a degree where it does not influence the electron trajectory. More preferably, if the resistance ratio is set to $5 \leqq R2/R1 \leqq 100$, it is possible to mitigate the above-described influence of deposition on the side surface, and sufficiently reduce the degree of sensitivity and influence on the electron trajectory due to deviation of the position of the spacer 1020, while establishing a good electrical connection between the spacer 1020 and the first or second conductive member. The high-resistance film 1022 on the side surface, and the high-resistance film 1022 on the first facing surface and the second facing surface may he made of the same material, or different materials.

Next, the function of the spacer 1020 will be described.

Figure 4:
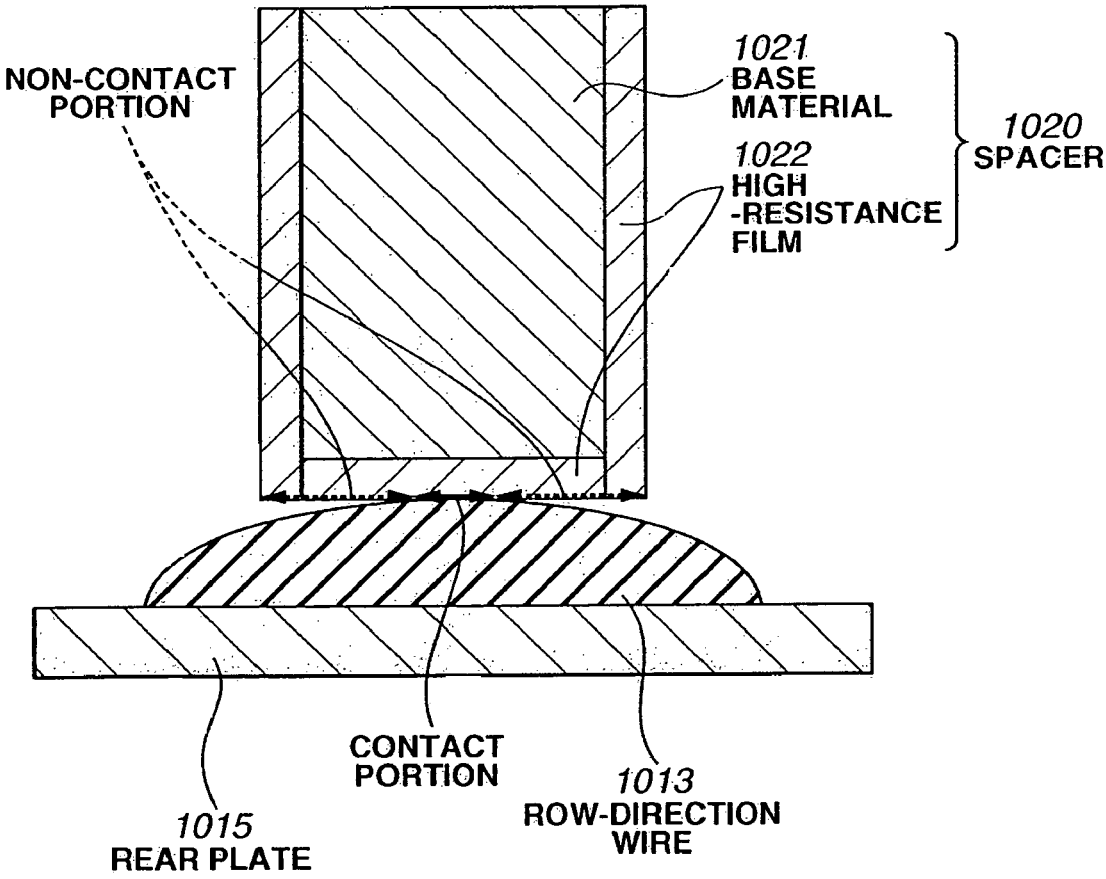
FIG. 4 is an enlarged schematic diagram illustrating a contact portion between the spacer and a row-direction wire.

FIG. 4 is an enlarged schematic diagram illustrating a contact portion between the spacer 1020 and the row-direction wire 1013.

As shown in FIG. 4, the first facing surface of the spacer 1020 contacts the row-direction wire 1013 formed on the rear plate 1015 at a partial, intermediate portion of the spacer 1020 in the direction of the thickness of the spacer 1020. Such a contact state is provided because the upper surface of the row-direction wire 1013 or the first facing surface is not always formed as a flat surface, and the upper surface of the row-direction wire 1013 is convex toward the faceplate 1017, and/or the first facing surface is convex toward the rear plate 1015. In the first facing surface, a region contacting the row-direction wire 1013 is termed a "contact portion", and a region not contacting the row-direction wire 1013 is termed a "non-contact portion".

The potential of the surface of the spacer 1020 obtained by forming the high-resistance film 1022 on the surface of the base material 1021 has a potential distribution determined by resistance division in accordance with the resistance distribution on the surface. In general, the potential distribution on the surface of the spacer 1020 is different from the potential distribution when the spacer 1020 is absent. Accordingly, when the positional relationship between the spacer 1020 and the electron emitting element 1012 near the spacer 1020 deviates from a normal state, since the surrounding electric field changes in accordance with the potential distribution on the surface of the spacer 1020 irrespective of the presence or absence of charging, the electron trajectory is considerably influenced.

Figure 5A:
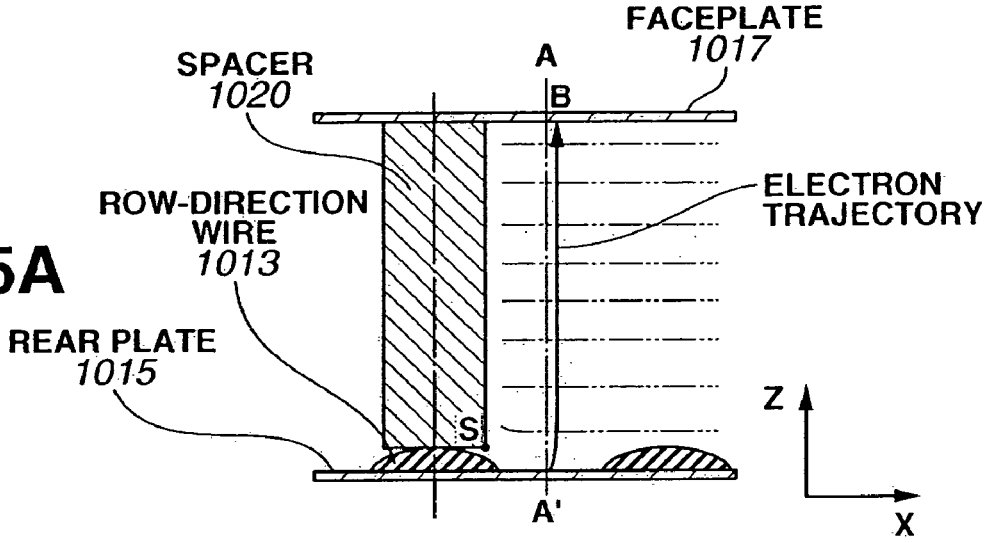
FIGS. 5A to 5C are diagrams which each illustrate equipotential lines and an electron trajectory near the spacer when a resistance ratio of a side surface to a first facing surface of the spacer is large.
Figure 5B:
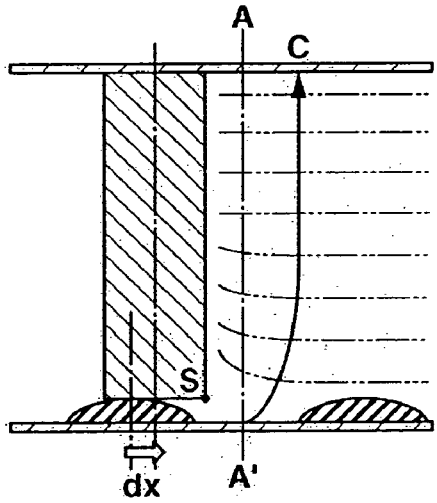
Figure 5C:
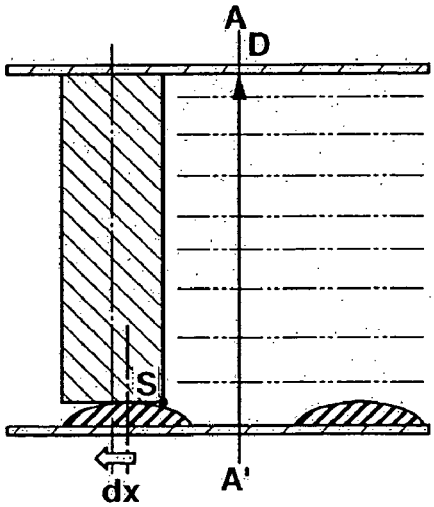
Figure 6:
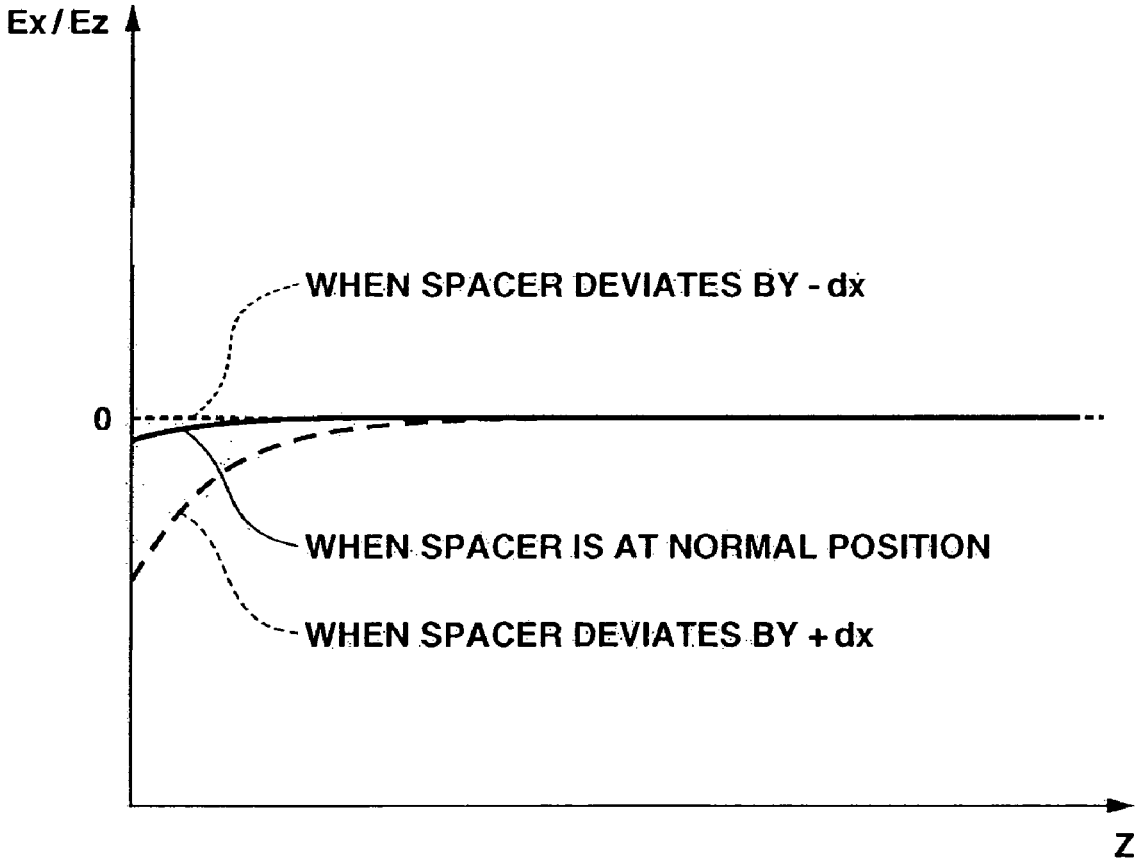
FIG. 6 is a graph obtained by plotting electric fields along line A-A' shown in FIGS. 5A to 5C.

Each of FIGS. 5A to 5C illustrates equipotential lines and an electron trajectory near the spacer 1020 when a low-resistance film, for example, made of metal, is formed on the first facing surface, i.e., when the resistance ratio of the side surface to the first facing surface of the spacer 1020 is large. When the low-resistance film is formed on the first facing surface, the potential on the first facing surface changes little at the contact portion (and the non-contact portion) with the first conductive member (the row-direction wire 1013 in this case), and is substantially equal to the potential of the row-direction wire 1013. FIG. 6 is obtained by plotting electric fields along line, A-A' shown in FIGS. 5A to. 5C (the normal of the rear plate 1015 passing through the electron emitting portion of the electron emitting element closest to the spacer 1020 (see FIGS. 1 and 2)). The abscissa represents the distance z from the surface of the rear plate 1015 (the electron emitting portion of the electron emitting element 1012 shown in FIGS. 1 and 2) in the z direction shown in FIG. 5A, and the ordinate represents the ratio Ex/Ez of the electric field in the x direction to the electric field and in the z direction shown in FIG. 5A.

When the spacer 1020 is at a normal position (see FIG. 5A), the potential of the end portion (point S shown in FIG. 5A) of the first facing surface is lower than the potential at a point in space corresponding to point S when the spacer 1020 is absent, and the electric-field ratio Ex/Ez is negative near the rear plate 1015 (as indicated by a solid line in FIG. 5A). Accordingly, electrons emitted from the electron emitting element 1012 near the spacer 1020 (see FIGS. 1 and 2 are deflected slightly in the x direction near the rear plate 1015. As a result thereof, and owing to the influence of the electric field Ez generated by a voltage applied to the metal back 1019 (see FIGS. 1 and 2), the electrons travel along a trajectory shown in FIG. 5A, and reach point B at the faceplate 1017.

When the position of the spacer 1020 deviates from that shown in FIG. 5A by a distance dx in the direction towards the electron emitting element 1012 (see FIGS. 1 and 2), as shown in FIG. 5B, point S set to a potential lower than a normal potential approaches the electron emitting element 1012. As a result, as indicated by a broken line in FIG. 6, the electric field along line A-A' is represented by Ex/Ez<0 at a portion near the rear plate 1015, and has a magnitude larger than when, the spacer 1012 is at a normal position. Accordingly, electrons emitted from the electron emitting element 1012 travel along a trajectory shown in FIG. 5B, and reaches point C that greatly deviates from a normal point on the faceplate 1017. That is, when the position of the spacer 1020 having a low-resistance film formed on its first facing surface deviates from a normal position in a direction towards the electron emitting element 1012, the trajectory of electrons emitted from the electron emitting element 1012 is deflected in a direction away from the spacer 1020 as compared to a case where the spacer 1020 is at a normal position and the trajectory terminates at point B.

On the other hand, when the spacer 1020 deviates by a distance dx in a direction away from the electron emitting element 1012 near the spacer 1020 (see FIGS. 1 and 2), as shown in FIG. 5C, point S set to a potential lower than a normal potential is displaced further away from the electron emitting element 1012. As a result, as indicated by a broken line in FIG. 6, the electric-field ratio. Ex/Ez along line A-A' becomes smaller than that when the spacer 1020 is at a normal position, and becomes substantially zero (Ex is substantially zero). Accordingly, electrons emitted from the electron emitting element 1012 separated from the spacer 1020 travel substantially without being deflected, and reach point D on the faceplate 1017 (FIG. 5C). That is, the position of arrival of electrons is closer to the spacer 1020 as compared with when the spacer 1020 is at a normal position.

When the high-resistance film 1022 having the sheet resistance value R1 that is higher by several orders of digits than a low-resistance film, made of, for example, metal, is formed on the first facing surface (see FIG. 2), i.e., when the resistance ratio of the side surface to the first facing surface is smaller, the potential of the non-contact portion of the first facing surface 1013 increases. The amount of change of the potential at the non-contact portion is determined by resistance division on the surface of the spacer 1020 provided by the resistance value R1 of the first facing surface and the resistance value R2 of the side surface, and varies as a function of the area of the non-contact portion and the resistance ratio of the side surface to the first facing surface. More specifically, the amount of increase of the potential of the non-contact portion is larger as the area of the non-contact portion is larger and the resistance ratio is smaller (as the resistance value of the first facing surface is larger).

Figure 7A:
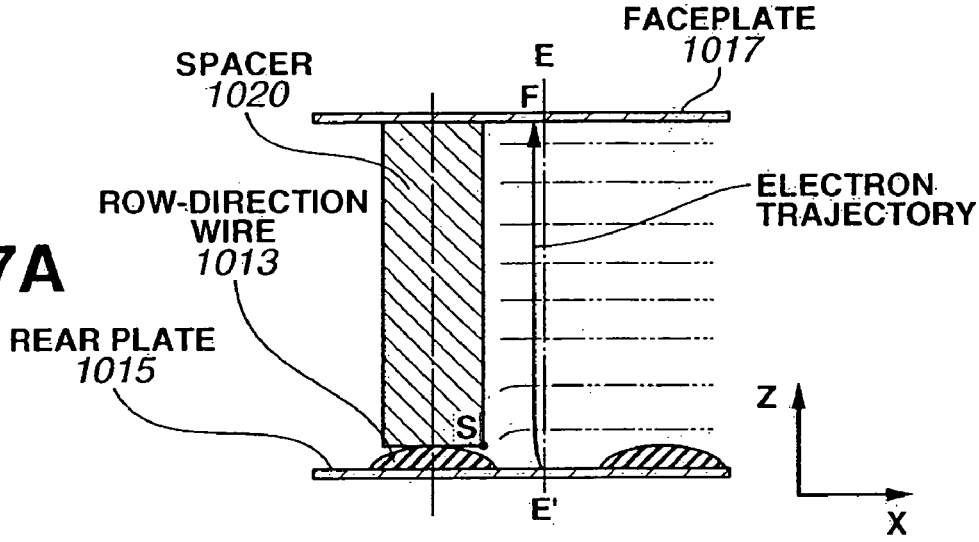
FIGS. 7A to 7C are diagrams which each illustrate equipotential lines and an electron trajectory near the spacer when a resistance R1 of a first facing surface is equal to a resistance R2 at a side surface (when a resistance ratio R2/R1=1)
Figure 7B:
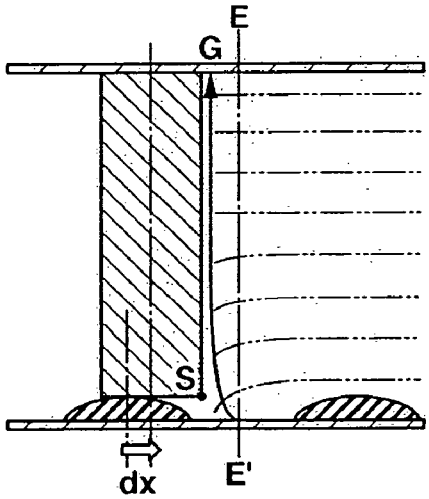
Figure 7C:
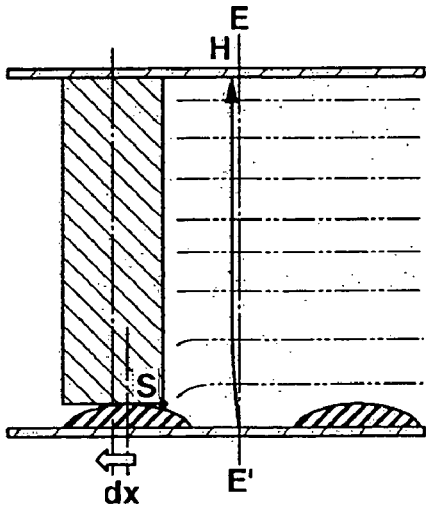
Figure 8:
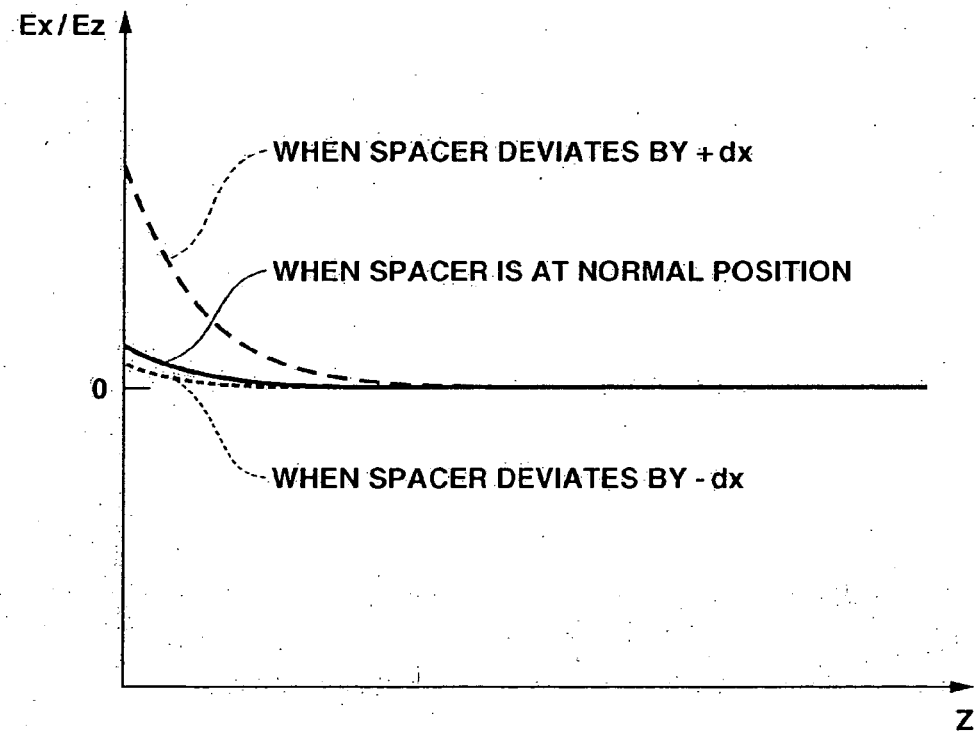
FIG. 8 is a graph obtained by plotting electric fields along line E-E' shown in FIGS. 7A to 7C.

Each of FIGS. 7A-7C illustrates equipotential lines and an electron trajectory near the spacer 1020 when the resistance R1 of the first facing surface is equal to the resistance R2 of the side surface (when the resistance ratio R2/R1=1). FIG. 8 is obtained by plotting electric fields along line E-E' shown in FIGS. 7A-7C.

When the spacer 1020 is at a normal position (see FIG. 7A), the potential of the end portion (point S shown in FIG. 7A) of the first facing surface of the spacer 1020 increases compared with the potential at a position corresponding to point S when the spacer 1020 is absent. In accordance with increase of the potential of the non-contact portion, the electric field near the spacer 1020 is represented by Ex/Ez>0 at a portion near the rear plate 1015, the trajectory of electrons emitted from the electron emitting element 1012 near the spacer 1020 (see FIGS. 1 and 2) is deflected in a direction slightly towards the spacer 1020, and reaches point F shown in FIG. 7A.

When the spacer 1020 deviates by a distance dx in a direction towards the spacer 1020 (see FIGS. 1 and 2), as shown in FIG. 7B, the length of the non-contact portion changes. In the case of FIG. 7B, since the length of the non-contact portion at a side from where the spacer 1020 is displaced increases, the amount of increase of the potential increases, and the electric-field ratio Ex/Ez increases. Accordingly, electrons emitted from the electron emitting element 1012 near the spacer are greatly attracted by the spacer 1020 and more greatly deflected from their trajectory in FIG. 7A, and travel along the trajectory shown in FIG. 7B, reaching point G. That is, the position of the spacer 1020 in which the resistance ratio of the side surface to the first facing surface is small deviates from a normal position, the trajectory of electrons emitted from the electron emitting element 1012 towards which the spacer 1020 approaches is more displaced in a direction towards the spacer 1020 than the position of arrival (point F) when the spacer 1020 is at a normal position.

On the other hand, when the spacer 1020 deviates by dx in a direction away from the electron emitting element 1012 (see FIGS. 1 and 2), as shown in FIG. 7C, since the length of the non-contact portion decreases, the amount of increase of the potential decreases, and the electric-field ratio Ex/Ez becomes relatively smaller. Accordingly, deflection of electrons emitted from the electron emitting element 1012 that is now more separated from the spacer 1020 decreases, and the electron trajectory changes in a direction away (repelled) from the spacer 1020 compared with when the spacer 1020 is at a normal position.

As described above, when the resistance ratio of the high-resistance film 1022 formed on the first facing surface to that formed on the side surface (see FIG. 2) is large or when the resistance ratio of the high-resistance film 1022 formed on the first facing surface to that formed on the side surface is value 1, the electron trajectory is influenced in accordance with positional deviation of the spacer 1020, and electrons emitted from the electron emitting element 1012 near the spacer 1020 (see FIGS. 1 and 2) reach a position different from a position of arrival when the spacer 1020 is disposed at a normal position, resulting in a possibility of degrading a desired performance of a display apparatus.

The inventors of the present invention have studied influence on the electron trajectory caused by deviation of the positional relationship between the spacer 1020 and an electron emitting element 1012 near the spacer 1020 as shown in FIGS. 1 and 2, according to detailed numerical simulation and experiments. The results indicate that by controlling the resistance ratio R2/R1 of the resistance R2 of the side surface to the resistance R1 of the first facing surface to within a certain range, the electric field near the spacer 1020 and the electron emission element 1012 can be maintained substantially constant-irrespective of a deviation of the positional relationship between the spacer 1020 and the electron emitting element 1012, and as a result, the influence on the electron trajectory can be minimized.

FIG. 9 illustrates the dependency of the degree of sensitivity (the degree of influence) of the electron trajectory with respect to the amount of deviation of the position of the spacer 1020 on the resistance ratio R2/R1 of the side surface to the contact surface, obtained according to simulation. The degree of sensitivity (the degree of influence) represented as the ordinate is defined by $dX_{beam}/dx_{sp}$ when the amount of position deviation of the spacer 1020 from a normal position is represented by $dx_{sp}$, and the amount of deviation of the electron trajectory near the spacer 1020 from a normal position of arrival is represented by $dx_{beam}$. In FIG. 9, a curve illustrated by a solid line shows a result of calculation for electrons emitted from the electron emitting element 1012 at a side towards which the spacer 1020 is displaced (positionally deviated), and a curve illustrated by a broken line is a result of a calculation for electrons emitted from the electron emitting element 1012 at a side where the spacer 1020 is displaced away from element 1012. When the value of $dx_{beam}$ is positive, it indicates that the electron trajectory is displaced towards the spacer 1020 in accordance with the positional deviation of the spacer 1020. When the value of $dx_{beam}$ is negative, it indicates that the electron trajectory moves in a direction of being repelled (away) from the spacer 1020 in accordance with positional deviation of the spacer 1020.

As shown in FIG. 9, the degree of sensitivity with respect to the position deviation of the spacer 1020 changes as the resistance ratio changes. Particularly, when the resistance ratio is small and large, the degree of sensitivity has reverse signs. Accordingly, it can be understood that the degree of sensitivity with respect to the position deviation of the spacer 1020 is extremely small at a certain intermediate condition.

In an ordinary electron beam apparatus, there exists an allowed amount of deviation of an electron trajectory from a normal position in order to satisfy desired characteristics of the apparatus. For example, in an image forming apparatus, if the deviation of the position of arrival of electrons from a normal position is to a degree incapable of being visually recognized in the resulting displayed image, and the deviation does not degrade the picture quality. The range of the allowed amount of deviation changes depending on the functions and the configuration of the electron beam apparatus. For example, in the case of an image forming apparatus, the range is set depending on the pitch and the size of pixels. If such an allowed range is set, it is possible to set a range of the resistance ratio for reducing the degree of sensitivity to the positional deviation of the spacer 1020 and thereby prevent degradation of characteristics of the apparatus. Although not clearly illustrated in FIG. 9, a range of the resistance ratio in which the broken line (calculation for electrons emitted from the electron emitting element 1012 at a side where the spacer 1020 is displaced therefrom) is within a range of the allowed amount of change of the beam position is 2 to 200.

Although the foregoing description is described in the context of contact between the spacer 1020 and the first conductive member at the rear plate 1015, the invention can also be applied to contact between the spacer 1020 and the second conductive member on the faceplate 1017. However, since an electron beam is accelerated from the rear plate 1015 toward the faceplate 1017, the electron trajectory tends to be greatly deflected at the rear plate 1015. Accordingly, in the present invention, at least for contact between the spacer 1020 and the first conductive member, it is necessary to reduce the degree of sensitivity with respect to position deviation of the spacer 1020, and set a resistance ratio for mitigating degradation of characteristics.

Although the foregoing description is about contact of the first facing surface of the spacer 1020 with the first conductive member (the row-direction wire 1013 in this case) whose central portion is convex toward the faceplate 1017, the invention can also be applied to a case in which an edge portion of the first conductive member protrudes toward the faceplate 1017, or to a case in which a central portion or an edge portion of the first facing surface of the spacer 1020 protrudes toward the rear plate 1015. The situation is the same when the thickness of the spacer 1020 having the shape of a long plate or a rib is not uniform in the longitudinal direction, or the spacer 1020 meanders or warps in the longitudinal direction. That is, the present invention can deal with variations in the distance between, the spacer 1020 and the adjacent electron emitting element 1012.

Although in the foregoing description, the spacer 1020 has the shape of a long plate or a rib, in other embodiments the spacer 1020 may have the shape of a column. In any case, the effects of the present invention can be obtained if the resistance ratio of the side surface of the spacer 1020 adjacent to the electron emitting element 1012 to the first facing surface, or preferably, to the first facing surface and the second facing surface is within a designated range.

Next, a method for manufacturing the spacer 1020 will be described.

As described above, although the spacer 1020 of the present invention shown in FIGS. 1 and 2 may be formed according to a liquid-phase thin-film forming method in addition to a vapor-phase thin-film forming method, the manufacturing method of the present invention particularly adopts a vapor-phase thin-film forming method. More specifically, the spacer 1020 is manufactured by coating the high-resistance film 1022 on the base material 1021 according to a vapor-phase thin-film forming method, such as sputtering, electron-beam vacuum deposition, ion plating, ion-assisted vacuum deposition, CVD, plasma CVD, spraying, or the like. The vapor-phase thin-film forming method indicates formation of a thin film by depositing a fine-particle thin-film forming material flying in a space.

The spacer 1020 used in the present invention has different resistance values for the first facing surface (preferably the first facing surface) and the second facing surface, and the side surface adjacent to the electron emitting element 1012 (a side surface exposed to a space between the rear plate 1015 and the faceplate 1017). Such a spacer manufacturing method includes phase film formation a step of performing film formation from the direction of the first facing surface (or preferably the first facing surface and the second facing surface) and a step of performing film formation from the direction of the side surface adjacent to the electron emitting element 1012. A resistance ratio of the side surface to the facing surface can be provided by adopting different conditions for film formation from the direction of the facing surface and film formation from the direction of the side surface. More specifically, this can be realized by increasing the film forming time from the direction of the facing surface compared with the time of film formation from the direction of the side surface, or selecting a low-resistance material as a film forming material from the direction of the facing surface compared with a film forming material from the direction of the side surface. It is thereby possible to independently control film characteristics of the facing surface and film characteristics of the side surface. The direction of the facing surface and the direction of the side surface in the present invention indicate a direction substantially perpendicular to the first facing surface that is a contact surface with the rear plate 1015 or the second facing surface that is the contact surface with the faceplate 1017, and a direction substantially perpendicular to the side surface, respectively. The words "substantially perpendicular" indicate perpendicularity to a degree in which the amount of formed film of a film material differs between an intended surface (for example, the facing surface in the case of film formation on the facing surface) and an unintended surface (for example, the side surface in the case of film formation in the facing surface), and more specifically, indicates a direction of film formation in which a film is formed on an unintended surface only by straying.

The method for manufacturing the high-resistance film is not limited to the above-described embodiment. For example, in other embodiments, dipping may be used. Dipping is a film forming method using a liquid phase, and is advantageous from the viewpoint of cost because a more expensive vacuum apparatus is not required.

In the case of dipping, by coating a dispersion solution of metal-oxide fine particles, preferably fine particles equal to or less than 200 μm, or a sol solution obtained by mixing at least one of metal alkoxide, organic-acid metallic salt, and a derivative of such a material in order to provide a desired resistance value, and firing the coated film at 400 to 1,000° C. after drying it, an oxide film of zinc, or an oxide film of a mixture of zinc and a transition metal or lanthanoid is obtained.

More specifically, an oxide film of Cr and Zn can be used. A specific example will now be described.

An oxide film of Cr and Zn can be formed by coating a mixed liquid of coating agents SYM-CR015 and SYM-ZN20 made by Kabushiki Kaisha Kojundo Kagaku Kenkyusho on a spacer according to dipping (a raising speed of 0.3 mm/sec), drying the coated film at 120° C., and firing the dried film at 450° C. The resistance value can be adjusted by adjusting the ratio of Cr to Zn by changing the mixture ratio of the coating agents.

When raising the spacer, by making the contact surface (the first facing surface or the second facing surface) of the spacer face downward, the thickness of the contact surface can be intentionally increased by utilizing unevenness of the liquid due to gravity. By optimizing the raising condition, the sheet resistance of the facing surface can be adjusted to a desired value.

The thickness of the high-resistance film on the side surface of the spacer manufactured in the above-described manner was 100 μm, and the sheet resistance value was $5\times10^{10}$ Ω/□, the thickness of the high-resistance film on the facing surface was 500 μm, and the sheet resistance value was $1\times10^{10}$ ω/□. The sheet-resistance ratio of the side surface to the facing surface of the spacer was 5.

The present invention will now be described in further detail illustrating examples.

In the following examples, a multi-electron beam source obtained by performing matrix wiring of N×M (N=3,072, and M=1,024) surface-conduction electron emitting elements, each having a conductive fine-particle film between electrodes, using M row-direction wires and N column-direction wires was used as the multi-electron beam source.

EXAMPLE 1, COMPARATIVE EXAMPLE 1

Spacers used in these examples were manufactured in the following manner.

A base material for the spacer was obtained by providing a plate-shaped member having a height of 2 mm, a thickness of 200 μm, and length of 4 mm by cutting and polishing soda-lime glass. A nitride of Cr and Ge was formed on the cleaned base material according to vacuum deposition.

The nitride film of Cr and Ge used in these examples was formed by performing simultaneous sputtering of Cr and Ge targets in a mixed atmosphere of argon and nitrogen using a sputtering apparatus.

Figure 10A:
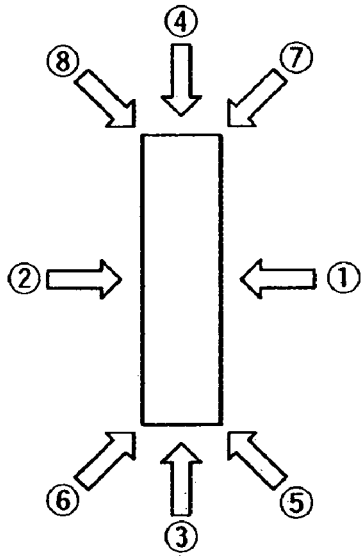
FIGS. 10A to 10C are diagrams each illustrating film forming directions when manufacturing the spacer used in examples.

As shown in FIG. 10A, a high-resistance film was formed on the surface of the spacer from side-surface directions (1) and (2), a first facing-surface direction (3) and a second facing-surface direction (4), and directions (5)-(8) having an angle of 45 degrees with respect to edge portions between the facing surfaces and the side surfaces, according to eight film forming operations. Film formation from 45 degrees was executed in order to assuredly obtain an electric connection between the high-resistance films formed on the side surfaces and the facing surfaces by controlling the resistances of the edge portions.

The resistance value of the high-resistance film was controlled by changing sputtering conditions at every film formation. The resistance value of the high-resistance film was controlled by changing the amount of addition of Cr by adjusting the power applied to the Cr and Ge targets, and the sputtering time.

The high-resistance film on the side surface of the spacer manufactured in these examples had a thickness of 200 nm, and a sheet resistance value of $4\times10^{11}$ Ω/□. The high-resistance film on the facing surface had a thickness of 2.00 nm, and a sheet resistance value of $3\times10^{10}$ Ω/□. Film formation from 45 degrees was performed in the same conditions as film formation on the side surface. The resistance ratio of the side surface to the facing surface of the spacer in these examples was about 13.

As shown in FIGS. 1 and 2, the spacer 1020 having the high-resistance film 1022 formed thereon was disposed on the row-direction wire 1013 on the rear plate 1015, and was fixed using the position fixing blocks 1023. The block 1023 for fixing the spacer 1020 at a desired position was manufactured using soda lime glass in the same manner as the spacer 1020. The block 1023 has the shape of a rectangular parallelepiped having a size of 4 mm×5 mm×1 mm thick, and has a groove having a width of 210 μm at a side surface so that an end portion in a longitudinal direction end portion of the base material 1021 of the, spacer 1020 can be inserted therein. After adjusting the spacers 1020 and the blocks 1023 when mounting them within the panel, so that the spacers 1020 are not inclined with respect to the faceplate 1017 and the electron-source substrate 1011, the spacers 1020 and the blocks 1023 were fixed using a ceramic-type adhesive. The spacer 1020 is not necessarily set at a predetermined position by using only the blocks 1023. For example, the spacer 1020 may be bonded using frit glass.

In these examples, in order to confirm the effects of the present invention, in addition to an apparatus in Which the installment position of the spacer 1020 (with respect to the row-direction wire 1013) is adjusted to a normal position, apparatuses, in which the installment position is shifted from the normal position by 25 μm and 50 μm were prepared.

Then, an envelope was formed together with the faceplate 1017 and the side-wall 1016 that were separately manufactured, and exhaust of air and formation of electron sources were performed. At that time, contact between the spacers 1020 and the faceplate 1017 was obtained by performing position adjustment so as to contact these members through the black member 1018*b*. Then, by performing sealing, the spacers 1020 were completely fixed to respective predetermined positions within the panel according to the atmospheric pressure applied from the outside of the envelope.

In an image forming apparatus using the display panel completed in the above-described manner, electrons were emitted from respective electron emitting elements 1012 by applying a scanning signal and a modulation signal by signal generation means (not shown) via terminals Dx1-Dxm, and Dy1-Dyn provided outside of the container. An image was displayed by accelerating an emitted electron beam by applying a high voltage to the metal back 1019 via a high-voltage terminal Hv to cause electrons to impinge upon the fluorescent screen 1018*a* to excite phosphors of respective colors to emit light. A voltage Va applied to the high-voltage terminal Hv was gradually increased to a limit voltage to generate discharge within a range of 3-12 kV, and a voltage Vf applied between the respective wires 1013 and 1014 was 14 V.

In a state of driving the image forming apparatus, the position of an emission spot by electrons emitted from the electron emitting element 1012 closest to the spacer 1020 was observed in detail. The result indicates that the emission spot was observed always at the normal position irrespective of the installment position (with respect to the row-direction wire 1013) of the spacer 1020.

As Comparative Example 1, a spacer in which an aluminum electrode was formed on the first facing surface of the spacer having the high-resistance film formed thereon in the same manner as in the above-described Example 1 was prepared, and the position of an emission spot resulting from electrons emitted from the electron emitting element closest to the spacer when-the installment position of the spacer was changed was observed in detail. The result indicates that, although when the spacer was installed at the normal position, an emission spot was observed at the normal position, the position of the emission spot deviated from the normal position as the installment position of the spacer was shifted.

When a spacer having an electrode formed on its first facing surface is used and the installment position of the spacer shifts by at least 10 μm, a positional deviation of an emission spot occurs to a degree which results in the influencing of the picture quality negatively. However, when the spacer of the present invention was used, a positional deviation of an emission spot, of a degree that would degrade the picture quality, was not observed, even if the installment position of at least 50 μm was present. Thus, the efficacy and supremacy of the present invention relative to a case where a prior art spacer is used, was confirmed.

EXAMPLE 2, COMPARATIVE EXAMPLE 2

Figure 10B:
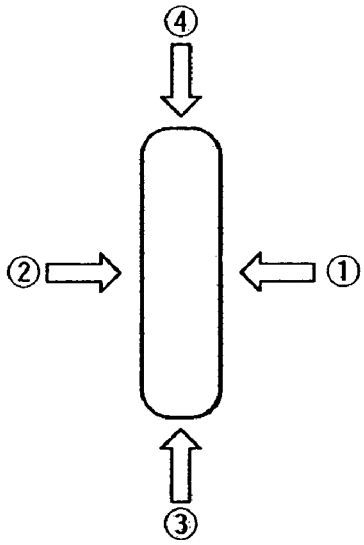
Figure 10C:
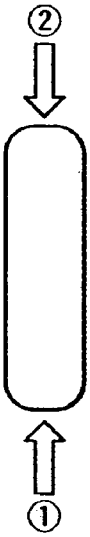
Figure 11:
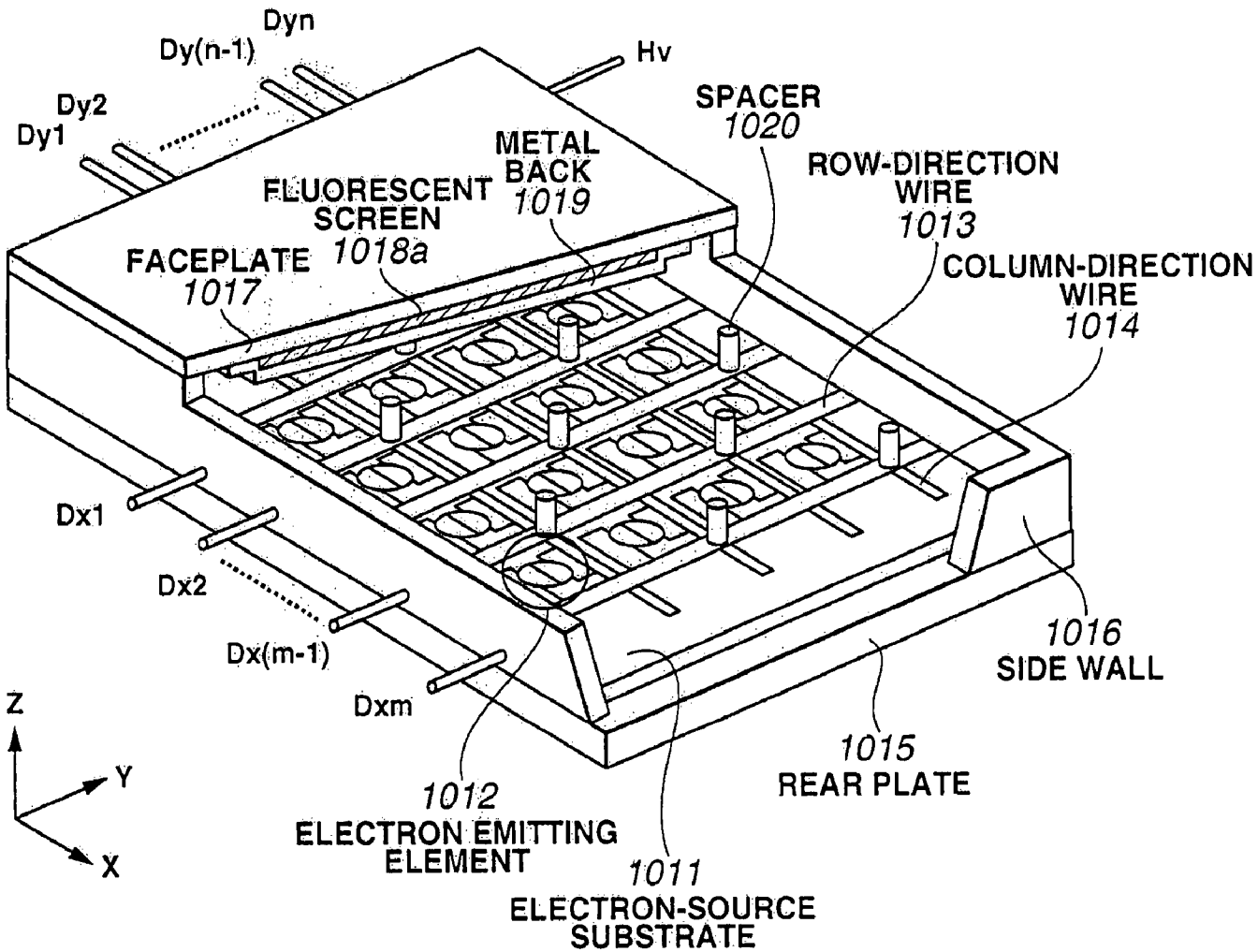
FIG. 11 is a partially broken perspective view illustrating an electron beam apparatus manufactured in Example 2 of the present invention.

In these examples, a cylindrical spacer base material as shown in FIGS. 10A-10C was manufactured by cutting and processing glass fibers having a diameter of 100 μm. The height of the spacer was 2 mm.

A nitride film of Cr and Ge as in the above-described Example 1 was formed on the surface of the cleaned base material as a high-resistance film. The high-resistance film was formed from the direction of the first facing surface, the direction of the second facing surface, and the direction of the side surface, according to three film forming operations. Film forming conditions were changed for the first facing surface and the second facing surface, and the side surface by changing the material ratio of Cr and Ge, in order to control the resistance value. In film formation on the side surface, a high-resistance film was formed uniformly on the entire region of the side surface by rotating the base material in a sputtering chamber during film formation.

The high-resistance film on the side surface of the spacer manufactured in these examples had a thickness of 300 nm, and a sheet resistance value of $5\times10^{10}$ Ω/□. The high-resistance film on the first facing surface and the second facing surface had a thickness of 200 nm, a sheet resistance value of $1\times10^{10}$ Ω/□. The resistance ratio of the side surface to the facing surface of the spacer in these examples was 5.

An image forming apparatus was manufactured by disposing the spacers 1020 having the high-resistance film 1022 formed thereon (see FIG. 2) on corresponding crossings of the row-direction wires 1013 and column-direction wires 1014 on the rear plate 1015. The installment positions of the spacers 1020 were varied to within a range equal to or less than 50 μm from normal installment positions. The normal installment position of the spacer 1020 in these examples is a position where a central position between four electron emitting elements 1012 surrounding the crossing of a row-direction wire 1013 and column-direction, wire 1014 where the spacer 1020 is to be disposed coincides with the central axis of the spacer 1020.

In an image forming apparatus using the completed display panel, electrons are emitted from respective electron emitting elements 1012 by applying a scanning signal and a modulation signal by a signal generator (not shown) via terminals Dx1-Dxm, and Dy1-Dyn provided outside of the container. An image was displayed as a result of accelerating an emitted electron beam by applying a high voltage to the metal back 1019 via the high-voltage terminal Hv to cause electrons to impinge upon the fluorescent screen 1018*a* to excite phosphors of respective colors to emit light. The voltage Va applied to the high-voltage terminal Hv was gradually increased to a limit voltage to generate discharge within a range of 3-12 kV, and the voltage Vf applied between the respective wires 1013 and 1014 was 14 V.

In a state of driving the image forming apparatus, the position of an emission spot by electrons emitted from the electron emitting element 1012 closest to the spacer 1020 was observed in detail. The result indicates that the emission spot was observed always at the normal position irrespective of the installment position of the spacer 1020.

The same evaluation was performed for an image forming apparatus using cylindrical spacers in which an Al electrode was formed on the first facing surface. The result indicates that variations in the position of en emission spot around a spacer were observed in accordance with the position of the spacer.

Although in these examples, the efficacy and supremacy of the present invention was confirmed.

EXAMPLE 3

In Example 3 of the present invention, a base material having the shape of a rectangular flat plate was manufactured by cutting a base material having the shape of a long plate obtained by processing a soda-lime-glass parent material according to heating drawing, to a necessary length. The base material had a height of 2 mm, a thickness of 200 μm, and a length of 100 mm.

A nitride of W and Ge was formed on the cleaned base material according to vacuum deposition in the same manner as in Example 1.

The nitride film of W and Ge used in Example 3 was formed by performing simultaneous sputtering of W and Ge targets in a mixed atmosphere of argon and nitrogen using a sputtering apparatus.

As shown in FIG. 10B, a high-resistance film was formed on the surface of the spacer base material from side-surface directions (1) and (2), a first facing-surface direction (3) and a second facing-surface direction (4). The nitride film of W and Ge used in Example 3 has different resistance values of the formed high-resistance film depending on the angle of the base material with respect to the direction of film formation. When the surface of the base material is perpendicular to the direction of film formation, i.e., when film formation is performed from directly above the surface of the base material, the resistance value is lowest. The resistance value increases as the inclination of the surface of the base material with respect to the film forming surface increases. The resistance value is highest when the surface of the base material is parallel to the direction of film formation, such that, in the case of a nitride film of W and Ge, the resistance value of the film is 100-1,000 times the resistance value when the surface of the base material is perpendicular to the direction of film formation.

Since the base material for the spacer processed according to heating drawing has a curvature at edge portions between the side surface and the facing surface, a high-resistance film is also formed on the edge portions at film formation from the direction facing the contact surface and the direction facing the side surface. Accordingly, even if film formation from a direction of 45 degrees as executed in Example 1 is not performed, electrical connection between the side surface and the facing surface could be secured by adjusting the resistance values of the high-resistance films on the side surfaces and the facing surfaces.

The resistance value of the high-resistance film was controlled by changing sputtering conditions at every film formation. The resistance value of the high-resistance film was controlled by changing the amount of addition of W by adjusting the power applied to the W and Ge targets.

The high-resistance film on the side surface of the spacer manufactured in Example 3 had a thickness of 20 nm, and a sheet resistance value of $2\times10^{11}$ Ω/□. The high-resistance film on the facing surface had a thickness of 200 nm, and a sheet resistance value of $3\times10^{10}$ Ω/□. The resistance ratio of the side surface to the facing surface of the spacer in Example 3 was about 6.7.

As shown in FIG. 1, the spacers 1020 having the high-resistance film formed thereon were fixed on the corresponding row-direction wires 1013 using the position fixing blocks 1023, as in Example 1, and an image forming apparatus was manufactured by combination with the faceplate 1017 and the side wall 1016, etc.

In Example 3, as in Example 1, in order to confirm the effects of the present invention, in addition to an apparatus in which the installment position of the spacer 1020 is adjusted to a normal position, apparatuses in which the installment position is shifted from the normal position by 25 μm and 50 μm were prepared.

In the completed image forming apparatus, electrons are emitted from respective electron emitting elements 1012 by applying a scanning signal and a modulation signal by signal generator (not shown) via terminals Dx1-Dxm, and Dy1-Dyn provided outside of the container. An image was displayed by accelerating an emitted electron beam by applying a high voltage to the metal back 1019 via the high-voltage terminal Hv to cause electrons to impinge upon the fluorescent screen 1018*a* to excite phosphors of respective colors to emit light. The voltage Va applied to the high-voltage terminal Hv was gradually increased to a limit voltage to generate discharge within a range of 3-12 kV, and the voltage Vf applied between the respective wires 1013 and 1014 was 14 V.

In a state of driving the image forming apparatus, the position of an emission spot by electrons emitted from the electron emitting element 1012 closest to the spacer 1020 was observed in detail. The result indicates that the emission spot was observed always at the normal position irrespective of the installment position of the spacer 1020. Hence, the effectiveness of the present invention was confirmed.

EXAMPLE 4, COMPARATIVE EXAMPLE 4

A spacer used in these examples of the present invention was obtained by forming a nitride film of W and Ge on the surface of a base material manufactured by cutting a soda-lime-glass parent material processed according to heating drawing, as in Example 3. The size of the spacer base material was the same as in Example 3.

In these examples, as shown in FIG. 10C, a high-resistance film was formed on the surface of the spacer only from a first facing-surface direction (1) and a second facing-surface direction (2). Film formation of a high-resistance film on the side surface was performed only by straying to the side surface during film formation of the high-resistance film on the facing surface. By thus utilizing straying as in these examples, a high-resistance film can be formed with a minimum number of film forming operations. Accordingly, the manufacture of the spacer is simplified, and is advantageous from the viewpoint of the production cost.

In these examples, the high-resistance film on the facing surface had a thickness of 500 nm, and a sheet resistance value of $1\times10^{9}$ Ω/□. The high-resistance film on the side surface had a thickness of 200 nm, a sheet resistance value of $1\times10^{11}$ Ω/□. The resistance ratio of the side surface to the facing surface of the spacer in these examples was about 100.

As shown in FIGS. 1 and 2, the spacers 1020 having the high-resistance film 1022 formed thereon were fixed on the corresponding row-direction wires 1013 using the position fixing blocks 1023, as in Example 1, and an image forming apparatus was manufactured by combination with the faceplate 1017 and the side wall 1016.

In these examples, as in Example 1, in order to confirm the effects of the present invention, in addition to an apparatus in which the installment position of the spacer 1020 is adjusted to a normal position, apparatuses in which the installment position is shifted from the normal position by 25 μm and 50 μm were prepared.

In the completed image forming apparatus, electrons are emitted from respective electron emitting elements 1012 by applying a scanning signal and a modulation signal by a signal generator (not shown) via terminals Dx1-Dxm, and Dy1-Dyn provided outside of the container. An image was displayed by accelerating an emitted electron beam by applying a high voltage to the metal back 1019 via the high-voltage terminal Hv to cause electrons to impinge upon the fluorescent screen 1018*a* to excite phosphors of respective colors to emit light. The voltage Va applied to the high-voltage terminal Hv was gradually increased to a limit voltage to generate discharge within a range of 3-12 kV and the voltage Vf applied between the respective wires 1013 and 1014 was 14 V.

In a state of driving the image forming apparatus, the position of an emission spot by electrons emitted from the electron emitting element 1012 closest to the spacer 1020 was observed in detail. The result indicates that the emission spot was observed always at the normal position irrespective of the installment position of the spacer 1020. Hence, the effectiveness of the present invention could be confirmed.

As described above, according to the present invention, the following effects are provided.

That is, in an electron beam apparatus, such as an image forming apparatus, it is possible to easily and inexpensively manufacture spacers insensitive to changes in a positional relationship between a spacer and an electron source near the spacer. By using the spacers of the present invention, it is possible to obtain a higher-quality electron beam apparatus even if there is less accuracy in assembly and processing. In a spacer manufacturing method according to the present invention, it is possible to provide a predetermined resistance ratio between a facing surface contacting an electrode, and a side surface exposed to a vacuum.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest reasonable interpretation so as to encompass all such modifications and equivalent structures and functions.

What is claimed is:

1. A method for manufacturing a spacer having a high-resistance film covering a surface of a base material, that is inserted between a first substrate having electron emitting elements and a first conductive member, and a second substrate having a second conductive member set to a potential different from a potential of the first conductive member in a state of contacting the first conductive member and the second conductive member, and electrically connects the first conductive member and the second conductive member via the high-resistance film, said method comprising:

a step of forming the high-resistance film according to a film forming step that includes a step of performing film formation from a direction of a first facing surface that faces the first conductive member, and a step of performing film formation from a direction of a side surface adjacent to the electron emitting element, wherein said film forming step is a step of forming the high-resistance film in which, when a sheet resistance value of the high-resistance film on the first facing surface is represented by R1, and a sheet resistance value of the high-resistance film on the side surface is represented by R2, R2/R1 is 2-200.

2. A method for manufacturing a spacer having a high-resistance film covering a surface of a base material, that is inserted between a first substrate having electron emitting elements and a first conductive member, and a second substrate having a second conductive member set to a potential different from a potential of the first conductive member in a state of contacting the first conductive member and the second conductive member, and electrically connects the first conductive member and the second conductive member via the high-resistance film, said method comprising:

a step of forming the high-resistance film according to a film forming step of performing film formation only from a direction of a first facing surface facing the first conductive member, and a direction of a second facing surface facing the second conductive member, wherein, when a sheet resistance value of the high-resistance film on the first facing surface and the second facing surface is represented by R1, and a sheet resistance value of the high-resistance film on a side surface adjacent to the electron emitting element is represented by R2, R2/R1 is 2-200.

* * * * *